US007033197B2

(12) United States Patent
Ling et al.

(10) Patent No.: US 7,033,197 B2
(45) Date of Patent: Apr. 25, 2006

(54) INTEGRATED ADD-IN CARD RETENTION MECHANISM

(75) Inventors: Yun Ling, Portland, OR (US); Daniel L. Tong, Beaverton, OR (US); Scott Noble, Beaverton, OR (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 10/327,554

(22) Filed: Dec. 20, 2002

(65) Prior Publication Data

US 2004/0121644 A1 Jun. 24, 2004

(51) Int. Cl.
*H01R 13/62* (2006.01)

(52) U.S. Cl. ..... 439/325; 439/328; 439/377; 439/153

(58) Field of Classification Search ..... 439/152, 439/153, 155, 157, 160, 353, 377, 325, 328; 361/801; 211/41.17
See application file for complete search history.

(56) References Cited

U.S. PATENT DOCUMENTS

| | | | | |
|---|---|---|---|---|
| 5,020,999 | A * | 6/1991 | Dewitt et al. | 439/328 |
| 5,470,240 | A * | 11/1995 | Suzuki | 439/157 |
| 5,584,705 | A * | 12/1996 | Lin | 439/157 |
| 5,660,552 | A * | 8/1997 | Suzuki et al. | 439/159 |
| 5,662,485 | A * | 9/1997 | Yip et al. | 439/157 |
| 5,676,555 | A * | 10/1997 | Yu et al. | 439/157 |
| 5,967,824 | A * | 10/1999 | Neal et al. | 439/342 |
| 6,033,254 | A * | 3/2000 | Neal et al. | 439/377 |
| 6,158,594 | A * | 12/2000 | Boe | 211/41.17 |
| 6,162,073 | A * | 12/2000 | Haq et al. | 439/159 |
| 6,276,950 | B1 * | 8/2001 | Yodogawa | 439/160 |
| 6,315,586 | B1 * | 11/2001 | Joyce et al. | 439/157 |
| 6,319,027 | B1 * | 11/2001 | Pickles et al. | 439/157 |
| 6,358,079 | B1 * | 3/2002 | Noble | 439/328 |
| 6,551,120 | B1 * | 4/2003 | Daskalakis et al. | 439/328 |
| 6,672,888 | B1 * | 1/2004 | Ku | 439/157 |

* cited by examiner

*Primary Examiner*—Tho D. Ta
(74) *Attorney, Agent, or Firm*—Blakely, Sokoloff, Taylor & Zafman LLP

(57) ABSTRACT

In one embodiment of the invention, the apparatus includes a socket connector. In one embodiment of the invention, the socket connector is to connect to a circuit board. The socket connector includes a housing to contain contacts, a socket disposed within the housing to receive an add-in card, and a retaining tab coupled to the housing to retain the add-in card in the socket. The retaining tab includes a lobe to mate with a retaining notch of the add-in card.

10 Claims, 5 Drawing Sheets

INTEGRATED ADD-IN CARD RETENTION MECHANISM

BACKGROUND

1. Field

Embodiments of the invention relate to the field of add-in cards, more specifically, to add-in card connectors.

2. Background

Add-in cards, such as peripheral component interconnect (PCI) cards and accelerated graphics port (AGP) cards, are often connected to circuit boards with various types of card-edge connectors. Card-edge connectors connect to a circuit board and typically include a socket that receives an add-in card. For card-edge connectors to work properly, the card-edge connector's signal and/or ground contacts must be in tight contact with the add-in card's signal and/or ground contacts. Sometimes, during transit and/or use, add-in cards can be jarred, bumped, or otherwise unsettled from a card-edge connector. Such jarring can cause the add-in card to lose electrical contact with the socket or even completely dislodge the add-in card from the card-edge connector socket.

Various mechanisms have been used to affix add-in cards to card-edge connectors. One such retention mechanism is shown in FIG. 1. FIG. 1 illustrates a memory connector including a mechanism for securing a memory module in a memory socket. As shown in FIG. 1, the memory connector 100 includes clips 102 for holding the memory module 104 in the socket 106. The clips 102 are hinged at the base of the socket 106. When the clips are closed, they rest on the notches of the memory module 104, holding it in the socket 106. One disadvantage of this retention mechanism is that it will not work when the memory module 104 is wider than the connector 100.

Another mechanism used to retain add-in cards is shown in FIG. 2. FIG. 2 illustrates a mechanism for retaining a PCI card in a card-edge connector socket. As shown in FIG. 2, a PCI card 202 is plugged into a card-edge connector 204. The card-edge connector 204 is connected to a circuit board (not shown). The PCI card 202 includes a mounting bracket 206 and screw 208, which are used to fasten the add-in card to a chassis or frame (not shown). One disadvantage of this retention mechanism is that it only secures one side of the PCI card 202. For relatively large and bulky add-in cards, a single screw 208 on one side of the PCI card may not adequately secure it in the card-edge connector 204.

BRIEF DESCRIPTION OF THE DRAWINGS

The invention may best be understood by referring to the following description and accompanying drawings that are used to illustrate embodiments of the invention. In the drawings.

DETAILED DESCRIPTION

In the following description, numerous specific details are set forth. However, it is understood that embodiments of the invention may be practiced without these specific details. In other instances, well-known circuits, structures and techniques have not been shown in detail in order not to obscure the understanding of this description.

Figure 1:
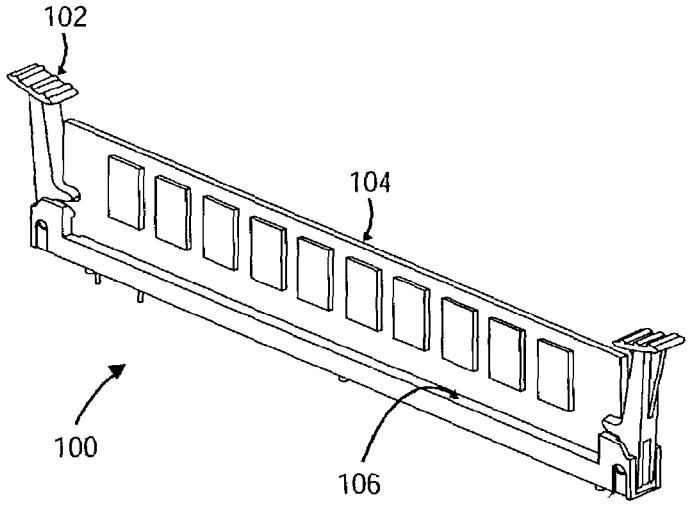
FIG. 1 illustrates a memory connector including a mechanism for securing a memory module in a memory socket.
Figure 2:
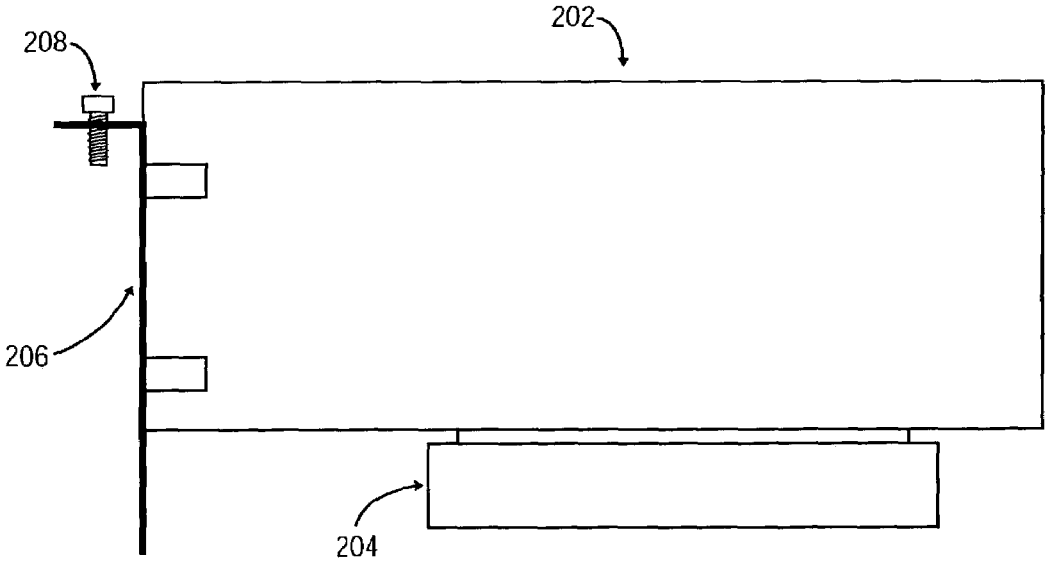
FIG. 2 illustrates a mechanism for retaining a PCI card in a card-edge connector socket.
Figure 3:
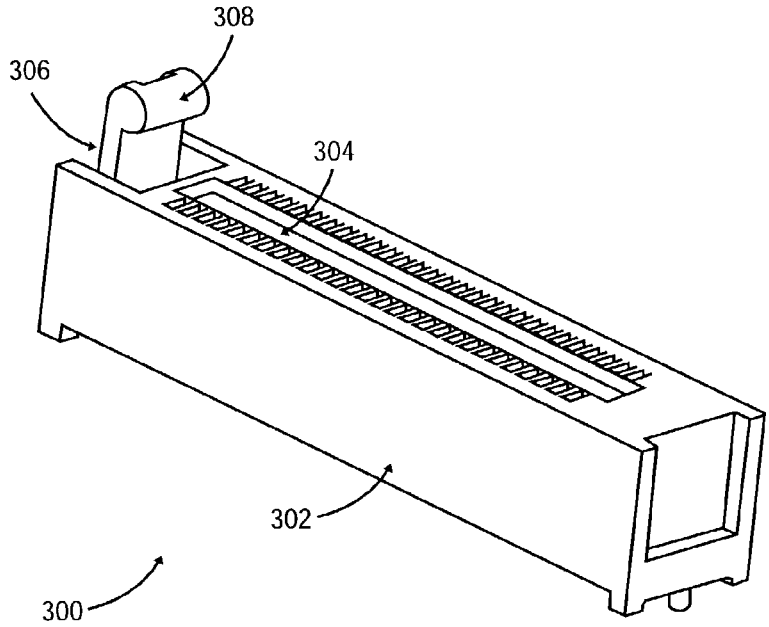
FIG. 3 illustrates a socket connector, according to embodiments of the invention.

FIG. 3 illustrates a socket connector, according to embodiments of the invention. The socket connector 300 facilitates an electrical connection between an add-in card or other printed circuit board and a backplane, motherboard, or other circuit board. In one embodiment of the invention, the socket connector 300 is to be mounted on a motherboard. In alternative embodiments of the invention, the socket connector 300 is mounted on a backplane or other circuit board. For example, the socket connector 300 can be surfaced mounted to a motherboard. More specifically, contacts (described below) within the socket connector 300 can be soldered to motherboard mounting pads. A motherboard mounting pad is an exposed metal surface of the motherboard (e.g., a section of the motherboard where solder mask has been etched away to expose a metal surface) with suitable finishing for solderability.

As shown in FIG. 3, the socket connector 300 includes a housing 302. In one embodiment of the invention, the housing 302 is formed from molded plastics. For example, in one embodiment of the invention, the housing 302 is formed using injection molding, while alternative embodiments of the invention are formed using other suitable molding techniques. In one embodiment of the invention, the housing 302 contains a number of contacts (not shown) for transmitting and receiving signals to and from an add-in card or printed circuit board.

As shown in FIG. 3 the socket connector 300 includes a socket 304. The socket 304 is a cavity that receives an add-in card or other electrical device (e.g., a printed circuit board). Typically, when an add-in card or other electrical device is inserted into the cavity, contacts on the add-in card will mate with the corresponding contacts contained within the housing 302. In other words, when an add-in card is inserted into the socket 304, an electrical connection between the various contacts is formed.

The socket connector 300 also includes a retaining tab 306, which is used to hold the add-in card firmly in the socket 304. The retaining tab 306 includes a lobe 308, which is used to mate with a retaining notch, as described in more detail below, with reference to FIGS. 4 and 5. As shown in FIG. 3, the retaining tab 306 is positioned on a lateral end of the housing 302. In one embodiment of the invention, the lobe 308 is positioned over the body of the housing 302, on the top end of the retaining tab 306.

As shown in FIG. 3, the lobe 308 is cylindrically shaped. However, according to alternative embodiments of the invention, the lobe 308 can be spherically shaped, shaped like an hourglass, or of any other suitable shape. In yet another alternative embodiment of the invention, the lobe 308 is cylindrically shaped with retaining disks on the circular ends of the lobe 308. In such an embodiment of the invention, the body of the lobe 308 is to mate with a retention notch of the add-in card.

In one embodiment of the invention, the retaining tab 306 and the housing 302 are formed from one piece of injection molded plastics. In an alternative embodiment of the invention, the retaining tab 306 can be fastened to the housing 302. For example, the retaining tab can be riveted to the housing 302. Alternatively, the retaining tab 306 can be screwed, glued, or otherwise fastened to the housing. In one embodiment of the invention, the retaining tab 306 is movable about a pivot point located at the base of the housing 302. Alternative embodiments of the invention called for other suitable ranges of motion.

Figure 4:
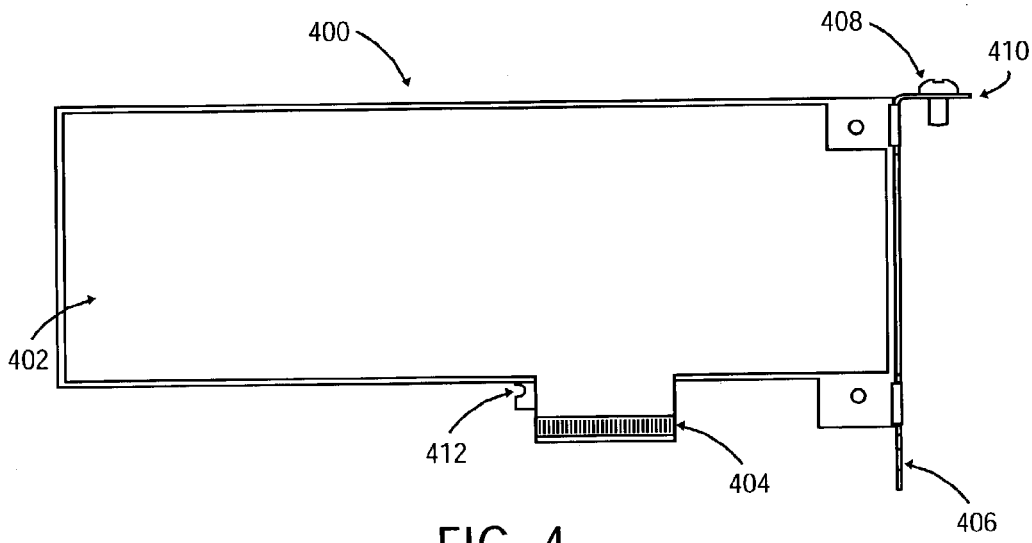
FIG. 4 illustrates an add-in card, according to embodiments of the invention.

FIG. 4 illustrates an add-in card, according to embodiments of the invention. FIG. 4 will be described with reference to the exemplary socket connector shown in FIG. 3. As shown in FIG. 4, the add-in card 400 includes a component area 402. Various microelectronic semiconductor devices including application-specific integrated circuits (ASICs), digital signal processors (DSPs), random access memories (RAMs), and/or other similar integrated circuits can be mounted on the component area 402 of add-in card 400. The add-in card 400 also includes a row of contacts 404, which transmit signals from components mounted on the component area 402 to another electronic device (e.g., a motherboard or backplane).

As shown in FIG. 4, the add-in card 400 includes a mounting bracket 406 and mounting screw 408. The mounting bracket 406 includes a mounting tail 410. In one embodiment of the invention, the mounting bracket 406 is to be fastened to a frame or chassis. For example, the add-in card 400 may be connected to a motherboard, which is contained in a metal chassis. After the add-in card 400 is plugged into a socket connector 300, the mounting tail 410 is fastened to the chassis with the mounting screw 408. In alternative embodiments of the invention, the mounting tail 410 is fastened to the chassis with other suitable fasteners (e.g., clips, rivets, bolts, adhesive connectors, etc.).

The add-in card 400 also includes a retaining notch 412. As shown in FIG. 4, the retaining notch 412 is a semicircular cutout of the add-in card 400. In one embodiment, the retaining notch 412 is located adjacent to the card-edge finger on which the contacts 404 are mounted. Alternatively, the retaining notch could be located elsewhere on the add-in card 400. For example, it could be located on the main body of the add-in card 400 (e.g., it could be a cut-out of the component area 402, with the opening facing downward). In one embodiment of the invention, the radius of the retaining notch 412 is approximately equal to the radius of the cylindrically shaped lobe 308 of the retaining tab 306. In alternative embodiments of the invention, where the lobe 308 is not cylindrically shaped (e.g., when the lobe 308 is shaped like an hourglass), the retention notch 412 is contoured to form a tight-fitting connection with the retention tab 306.

Figure 5A:
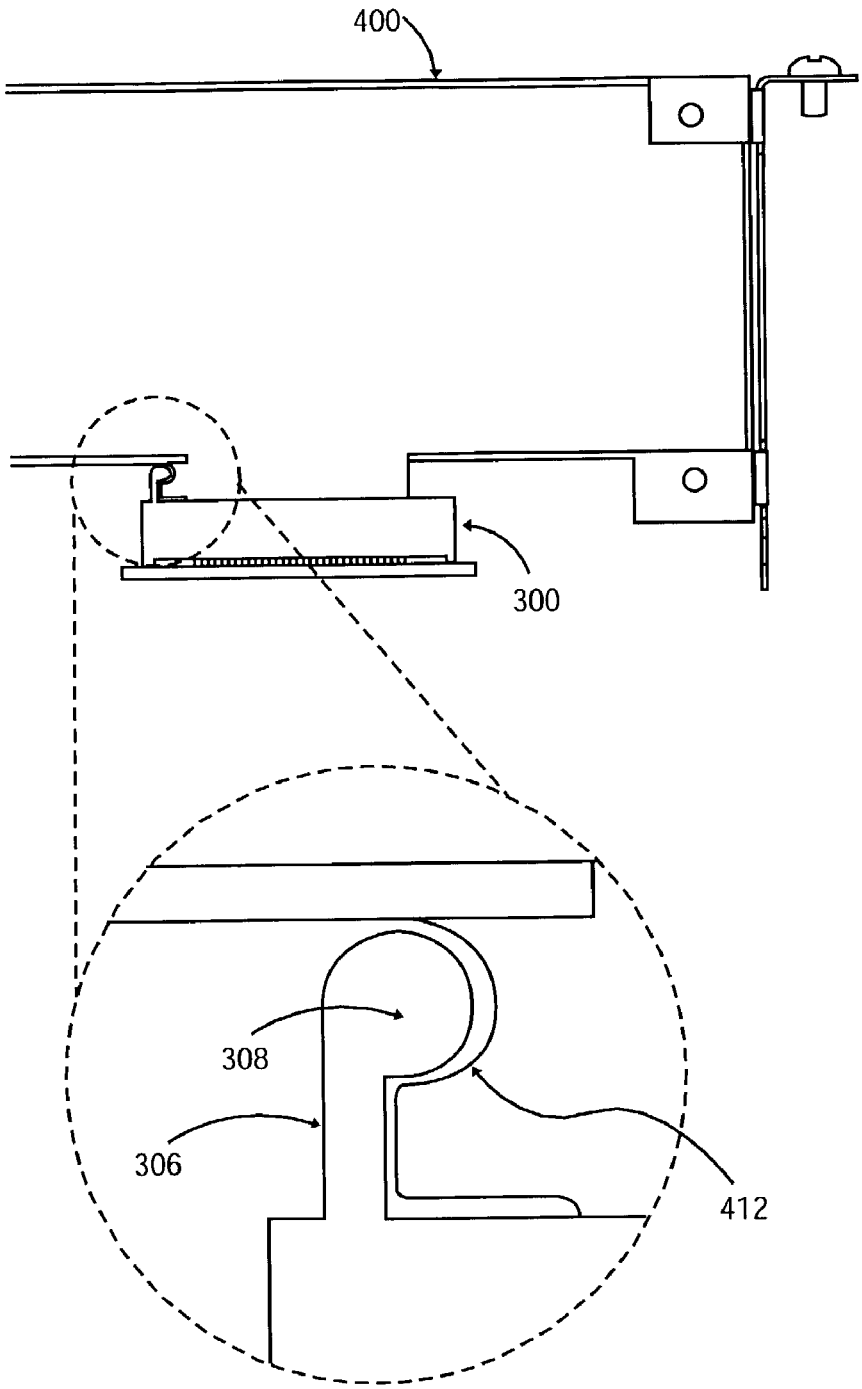
FIG. 5A illustrates an add-in card including a retaining notch coupled with a socket connector including a retaining tab, according to embodiments of the invention.
Figure 5B:
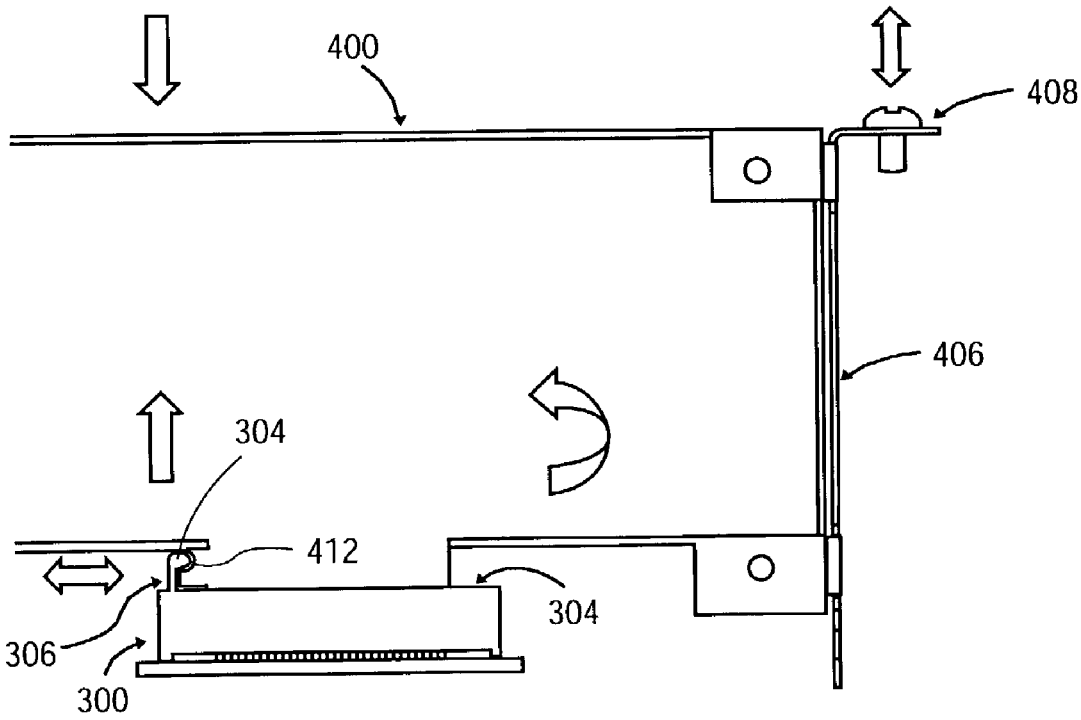
FIG. 5B illustrates movements of an add-in card and socket connector, according to embodiments of the invention.
Figure 6:
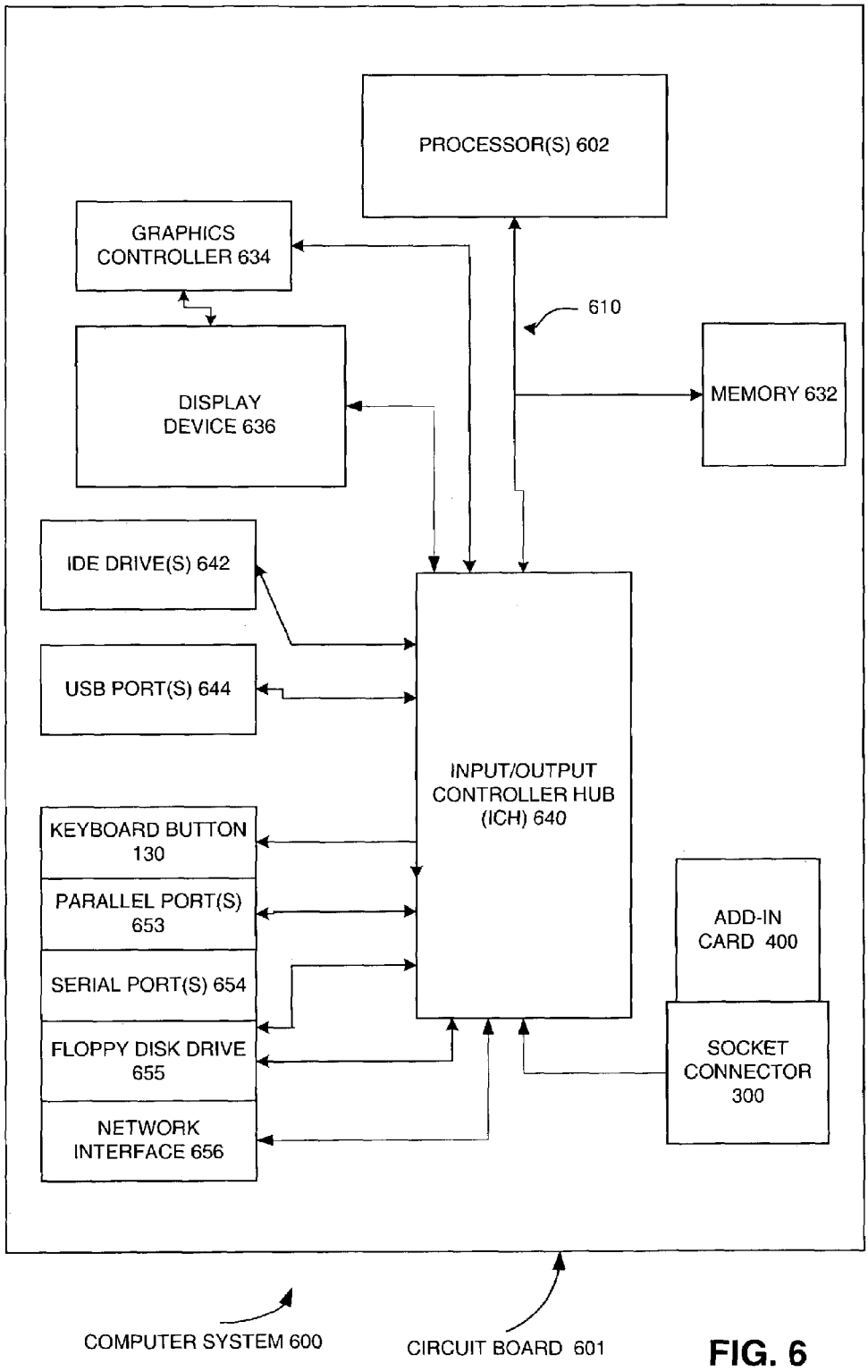
FIG. 6 illustrates an exemplary system comprising a socket connector and add-in card, according to embodiments of the invention.

While the description of FIGS. 3 and 4 discussed the components of the socket connector 300 and the add-in card 400, the discussion of FIGS. 5 and 6 will describe the mating of the retaining tab 306 with the retaining notch 412.

FIG. 5A illustrates an add-in card including a retaining notch coupled with a socket connector including a retaining tab, according to embodiments of the invention. When the add-in card 400 is plugged into the socket connector 300, the retaining tab 306 forms a tight fit with the retaining notch 412.

FIG. 5A also includes a close-up view of the retaining tab 306 and retaining notch 412, according to embodiments of the invention. In the close-up view, the tight fit is not shown to clearly illustrate the spatial relationship between the retaining tab 306 and retaining notch 412. For embodiments of the invention wherein the lobe 308 is shaped differently than that shown in FIG. 5A (see above), the retaining notch 412 is appropriately contoured to tightly fit around the lobe 308.

FIG. 5B illustrates movements of an add-in card and socket connector, according to embodiments of the invention. In FIG. 5B, the larger arrows represent forces applied to various parts of the add-in card. When the add-in card 400 is inserted into the socket connector 300, the retaining tab 306 is oriented so that downward force exerted on the add-in card 400 bends the retaining tab 306 away from the socket 304. As the add-in card slides into the socket 304, tension in the retaining tab 306 causes the lobe 308 to reorient into its original position (e.g., it springs back into its original upright position); thus mating with the retaining notch 412. After the add-in card 400 has been inserted into the socket connector 300, the mounting bracket 406 is fastened to a chassis (not shown) with the mounting screw 408.

When the add-in card 400 is removed from the socket connector 300, the mounting bracket 406 should first be unfastened from the chassis. For example, in one embodiment of the invention, the mounting screw 408 must be unthreaded from the chassis and mounting bracket 406. After removing the mounting screw 408, applying an upward force to the mounting bracket 406 or other suitable location on the add-in card 400 can remove the add-in card 400 from the socket connector 300. When an upward force is exerted on the add-in card 400, the force (if sufficiently strong) will bend the retaining tab 306 away from the socket 304, freeing the lobe 304 from the retaining notch 412. After freeing the lobe 308 from the retaining notch 412, the add-in card 400 can be lifted from the socket 304. In one embodiment of the invention, applying a rotational force to the add-in card 400 helps to free the lobe 304 from the retaining notch 412.

FIG. 6 illustrates an exemplary system comprising a socket connector and add-in card, according to embodiments of the invention. Although described in the context of system 600, the present invention may be implemented in any suitable computer system comprising one or more integrated circuits.

As illustrated in FIG. 6, computer system 600 comprises a circuit board 601, on which the following components are arranged. The computer system includes processor(s) 602. Computer system 600 also includes a memory 632, processor bus 610 and input/output controller hub (ICH) 640. The processor(s) 602, memory 632 and ICH 640 are coupled to the processor bus 610. The processor(s) 602 may comprise any suitable processor architecture and for one embodiment of the invention comprise an Intel® Architecture used, for example, in the Pentium® family of processors available from Intel® Corporation of Santa Clara, Calif. For other embodiments of the invention, computer system 600 may comprise one, two, three, or more processors, any of which may execute a set of instructions that are in accordance with embodiments of the present invention.

The memory 632 stores data (e.g., image data) and/or instructions, and may comprise any suitable memory, such as a dynamic random access memory (DRAM), for example. A graphics controller 634 controls the display of information display device 636.

The input/output controller hub (ICH) 640 provides an interface to I/O devices or peripheral components for computer system 600. The ICH 640 may comprise any suitable interface controllers to provide for any suitable communication link to the processor(s) 602, memory 632 and/or to any suitable device or component in communication with the ICH 640. For one embodiment of the invention, the ICH 640 provides suitable arbitration and buffering for each interface. The ICH 640 is also connected to an add-in card 600. In one embodiment of the invention, the add-in card 600 is connected to the circuit board 601 with a socket connector 300.

For one embodiment of the invention, the ICH 640 provides an interface to one or more suitable integrated drive electronics (IDE) drives 642, such as a hard disk drive (HDD) or compact disc read only memory (CD ROM) drive for example, to store data and/or instructions for example, one or more suitable universal serial bus (USB) devices through one or more USB ports 644. For one embodiment of the invention, the ICH 640 also provides an interface to a keyboard 651, a mouse 652, a floppy disk drive 655, one or more suitable devices through one or more parallel ports 653 (e.g., a printer), and one or more suitable devices through one or more serial ports 654.

Thus an add-in card retention mechanism has been described. While the invention has been described in terms of several embodiments, those skilled in the art will recognize that the invention is not limited to the embodiments described, can be practiced with modification and alteration within the spirit and scope of the appended claims. The description is thus to be regarded as illustrative instead of limiting.

What is claimed is:

1. An apparatus comprising:

a socket connector coupled to a circuit board, the socket connector including, a housing; and only one retaining tab coupled to the housing, the only one retaining tab including a lobe, the lobe being positioned on a first end of the housing; and an add-in card coupled to the socket connector, the add-in card including, first and second portions, the first portion being longer than the second portion;

a mounting bracket coupled to an end of the first portion opposing the first end of the housing to connect to a chassis; and a retaining notch on an end of the second portion adjacent to the first end of the housing coupled to the lobe to retain the add-in card in the socket connector.

2. The apparatus of claim 1, wherein the add-in card is longer than the socket connector.

3. The apparatus of claim 1, wherein the lobe mates with the retaining notch above the housing.

4. The apparatus of claim 1, wherein the add-in card is an Arapahoe card.

5. A system comprising:

a circuit board;

a random access memory unit coupled to the circuit board;

a processor coupled to the circuit board;

a socket connector coupled to the circuit board, the socket connector including, a housing to contain signal contacts;

a socket disposed within the housing;

only one retaining tab coupled to the housing, the only one retaining tab including a lobe positioned on a first end of the housing; and an add-in card coupled to the socket, the add-in card including first and second portions, the first portion being longer than the second portion;

a mounting bracket coupled to an end of the first portion opposing the first end of the housing to connect to a chassis; and a retaining notch on an end of the second portion adjacent to the first end of the housing coupled to the lobe to retain the add-in card in the socket.

6. The apparatus of claim 5, wherein the lobe is cylindrically shaped.

7. The apparatus of claim 5, wherein the retaining tab is movable about a pivot point at the base of the housing.

8. The apparatus of claim 5, wherein the retaining tab is on a lateral end of the housing, and wherein the lobe sits above the housing.

9. A method comprising:

inserting an add-in card including first and second portions, the first portion being longer than the second portion, and a retaining notch on a first end of the second portion into a socket connector, the socket connector including only one retaining tab on an end thereof adjacent to the first end of the second portion of the add-in card for retaining the add-in card in the socket connector, the retaining tab including a lobe, wherein the lobe mates with retaining notch of the add-in card; and connecting an end of the first portion of the add-in card to a chassis with a mounting bracket.

10. The method of claim 9, wherein the lobe is cylindrically shape.

* * * * *